United States Patent [19]

Higuchi et al.

[11] Patent Number: 5,069,149

[45] Date of Patent: Dec. 3, 1991

[54] MOTOR DRIVING DEVICE FOR SEWING MACHINE

[75] Inventors: Yoshiharu Higuchi, Yokkaichi; Kazuhisa Ito, Aichi, both of Japan

[73] Assignee: Brother Kogyo Kabushiki Kaisha, Nagoya, Japan

[21] Appl. No.: 701,092

[22] Filed: May 16, 1991

[30] Foreign Application Priority Data

Aug. 9, 1990 [JP] Japan ..... 2-212667

[51] Int. Cl.[5] ..... D05B 69/36

[52] U.S. Cl. ..... 112/277; 112/220; 112/300

[58] Field of Search ..... 112/277, 275, 220, 221, 112/121.11, 285, 291, 292, 300

[56] References Cited

U.S. PATENT DOCUMENTS

| | | | |
|---|---|---|---|
| 2,418,356 | 4/1947 | Kleber | 112/277 X |
| 2,833,235 | 5/1958 | Smellie | 112/277 |
| 4,233,919 | 11/1980 | Takahashi | 112/275 X |
| 4,437,423 | 2/1984 | Yamazawa | 112/292 |
| 4,498,078 | 2/1985 | Yoshimura et al. | 112/277 X |
| 4,554,879 | 11/1985 | Eguchi | 112/277 X |

FOREIGN PATENT DOCUMENTS 37-4322 3/1962 Japan .

*Primary Examiner*—Peter Nerbun
*Attorney, Agent, or Firm*—Oliff & Berridge

[57] ABSTRACT

A sewing machine including a mercury switch for detecting tilt of the sewing machine. When the tilt of the sewing machine is detected by the mercury switch, a machine motor of the sewing machine is inhibited from being driven. Accordingly, even if a foot switch for driving the machine motor is depressed under the tilted condition of the sewing machine, the machine motor is not driven, thereby improving the safety of the machine. Furthermore, when the sewing machine is tilted during driving of the machine motor, the inhibition of drive of the machine motor is canceled, and a driving speed of the machine motor is set to a low speed. Under this condition, an operator can easily adjust a fabric feeding device, a thread cutting device and a rotating hook.

13 Claims, 7 Drawing Sheets

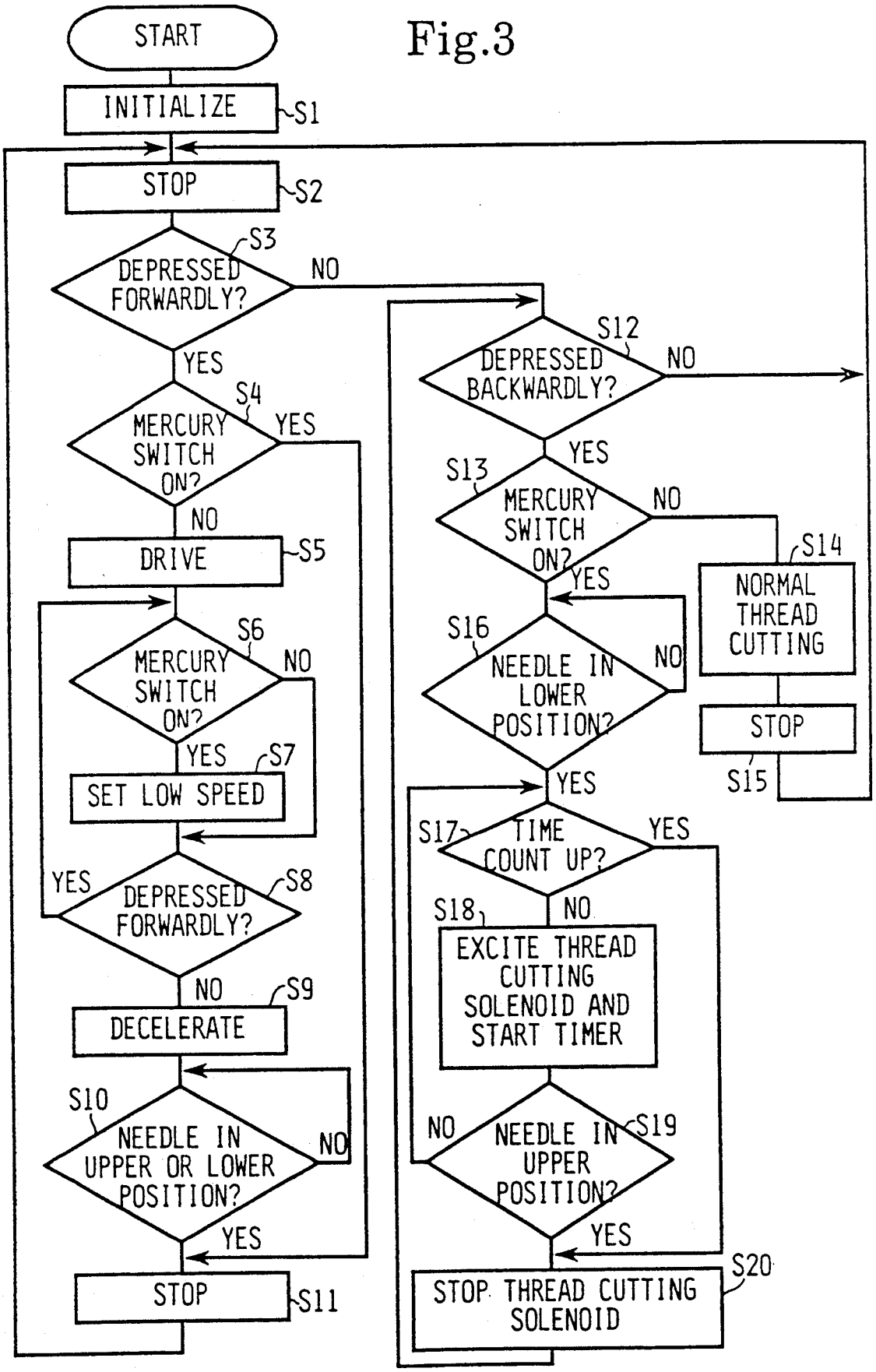
Fig.3
START
INITIALIZE
S1
STOP
S2
S3
DEPRESSED FORWARDLY?
NO
YES
S4
MERCURY SWITCH ON?
YES
NO
DRIVE
S5
S6
MERCURY SWITCH ON?
NO
YES
S7
SET LOW SPEED
YES
S8
DEPRESSED FORWARDLY?
NO
S9
DECELERATE
S10
NEEDLE IN UPPER OR LOWER POSITION?
NO
YES
STOP
S11
S12
DEPRESSED BACKWARDLY?
NO
YES
S13
MERCURY SWITCH ON?
NO
S14
NORMAL THREAD CUTTING
STOP
S15
YES
S16
NEEDLE IN LOWER POSITION?
NO
YES
S17
TIME COUNT UP?
YES
NO
S18
EXCITE THREAD CUTTING SOLENOID AND START TIMER
NO
S19
NEEDLE IN UPPER POSITION?
YES
S20
STOP THREAD CUTTING SOLENOID

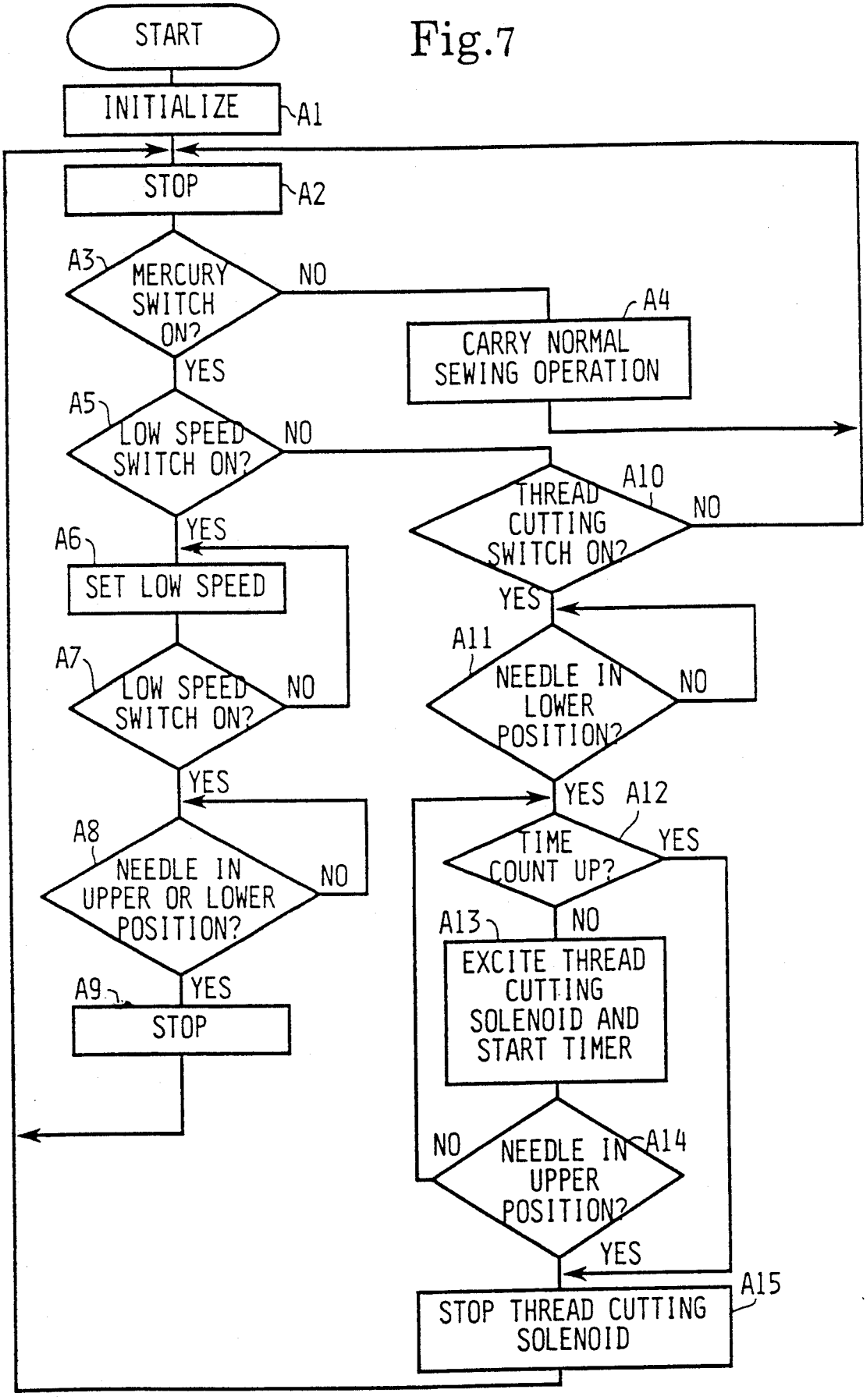
Fig.7
START
INITIALIZE
A1
STOP
A2
A3
MERCURY SWITCH ON?
NO
YES
A4
CARRY NORMAL SEWING OPERATION
A5
LOW SPEED SWITCH ON?
NO
YES
A6
SET LOW SPEED
A7
LOW SPEED SWITCH ON?
NO
YES
A8
NEEDLE IN UPPER OR LOWER POSITION?
NO
YES
A9
STOP
A10
THREAD CUTTING SWITCH ON?
NO
YES
A11
NEEDLE IN LOWER POSITION?
NO
YES
A12
TIME COUNT UP?
YES
NO
A13
EXCITE THREAD CUTTING SOLENOID AND START TIMER
A14
NEEDLE IN UPPER POSITION?
NO
YES
A15
STOP THREAD CUTTING SOLENOID

MOTOR DRIVING DEVICE FOR SEWING MACHINE

BACKGROUND OF THE INVENTION

1. Field of the Invention

The present invention relates to a motor driving device for a sewing machine, and more particularly relates to a motor driving device for a sewing machine including a machine motor fixed to the machine frame, wherein tilt of the machine frame is detected to control the drive of the machine motor.

2. Description of Related Art

In an industrial tiltable sewing machine of this type, a machine frame constructed of an arm and a bed is placed on a table. The bed is pivotably supported at its rear portion to the table, so that the machine frame can be tilted with respect to the table. In adjusting various devices provided within the bed, e.g., a fabric feeding device, a thread cutting device and a rotating hook, or adjusting tension of a timing belt wrapped on a lower shaft in the bed, the machine frame is tilted rearwardly to open a bottom portion of the bed. That is, such an adjustment is carried out when the machine frame is in a tilted condition. As such a sewing machine having the above construction, there is known a direct drive type sewing machine including an upper shaft and a motor shaft directly connected to one another in the arm of the machine frame. This type of sewing machine is provided with a foot switch for controlling driving and stoppage of the machine motor. However, if the foot switch is erroneously depressed during the adjustment as mentioned above under the tilted condition of the machine frame, the machine motor begins to be driven. As a result, a needle begins to be moved, thus causing a danger.

As a countermeasure for solving this problem, there is disclosed in U.S. Pat. No. 2,833,235, for example, a sewing machine including a tilt sensor for detecting the tilt of the arm or the machine frame. When the tilt of the machine frame is detected by the tilt sensor, the machine motor is inhibited from being driven even if the foot switch is depressed, thus improving the safety of the sewing machine.

In the above construction, when the machine frame is tilted, the machine motor cannot be driven at all. However, in adjusting various devices provided in the bed during the tilted condition of the machine frame, the adjustment may be performed more easily as the machine motor is driven. In this circumstance, it is demanded by a user or a customer engineer that the machine motor can also be driven when the machine frame is tilted.

SUMMARY OF THE INVENTION

It is an object of the present invention to provide a sewing machine which can also drive a machine motor when a machine frame is tilted.

It is another object of the present invention to provide a sewing machine which can facilitate adjustment of the various devices in the bed by enabling a machine motor to be driven during the tilted condition of a machine frame.

It is a further object of the present invention to provide a sewing machine which can drive a machine motor at a low speed when a machine frame is tilted, thereby ensuring safety.

According to the present invention, there is provided a motor driving device for a sewing machine comprising a machine motor fixed to a machine frame of the sewing machine, the machine frame being tiltable; detecting means for detecting tilt of the machine frame; drive inhibiting means for inhibiting drive of the machine motor when the tilt of the machine frame is detected by the detecting means; inhibition canceling means for canceling inhibition of the drive of the machine motor by the drive inhibiting means; and control means for controlling the drive of the machine motor in such a manner that when the tilt of the machine frame is detected by the detecting means, the drive inhibiting means is actuated by the control means, while when the detecting means detects the tilt of the machine frame during driving of the machine motor, the inhibition canceling means is actuated by the control means.

With this construction, when the machine frame is tilted, the drive inhibiting means is actuated by the control means to inhibit the drive of the machine motor. On the other hand, when the detecting means detects the tilt of the machine frame during driving of the machine motor, the inhibition canceling means is actuated by the control means to cancel the inhibition of the drive of the machine motor so that the machine motor continues to be driven.

That is, when the tilt of the machine frame is detected by the detecting means, the drive of the machine motor is inhibited by the drive inhibiting means, thereby improving safety. Furthermore, when the machine frame is tilted during driving of the machine motor, the machine motor continues to be driven by the actuation of the inhibition canceling means, thereby facilitating adjustment during the tilted condition of the machine frame.

BRIEF DESCRIPTION OF THE DRAWINGS

A preferred embodiment of the present invention will be described in detail with reference to the following figures wherein:

FIG. 3 is a flowchart showing control of the sewing machine according to the first preferred embodiment;

FIG. 7 is a flowchart showing control of the sewing machine according to the second preferred embodiment.

DETAILED DESCRIPTION OF THE PREFERRED EMBODIMENTS

An embodiment will be described in which the present invention is employed in an industrial sewing machine.

Figure 2:
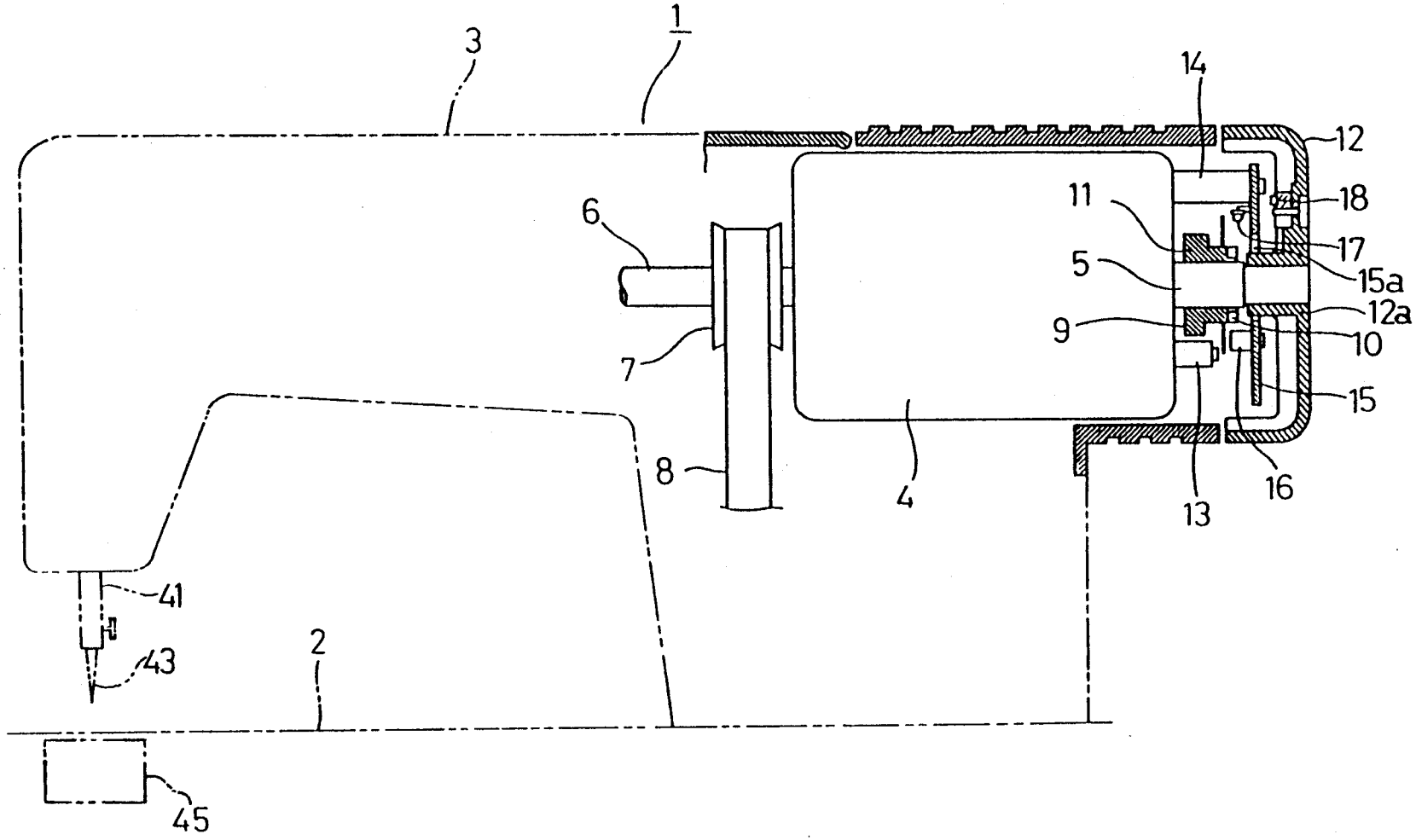
FIG. 2 is a vertical sectional view of an essential part of the sewing machine.
Figure 4:
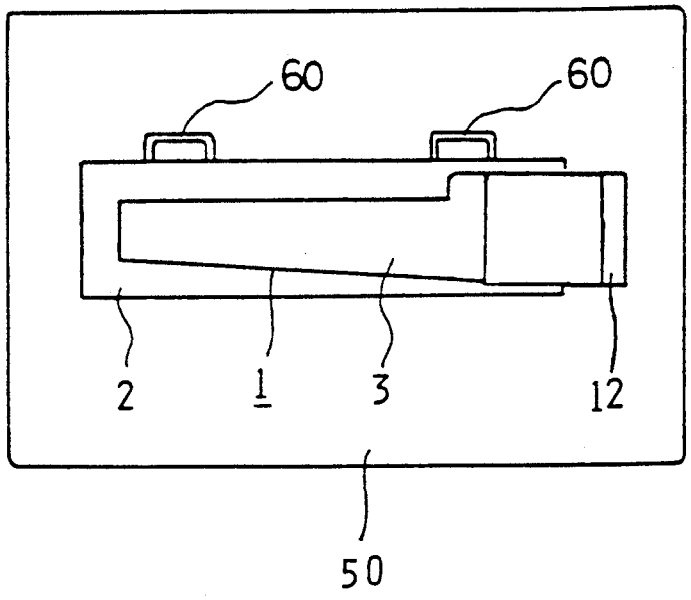
FIGS. 4 and 5 are top and side views, respectively, of a sewing machine frame rotatably supported on a table.
Figure 5:
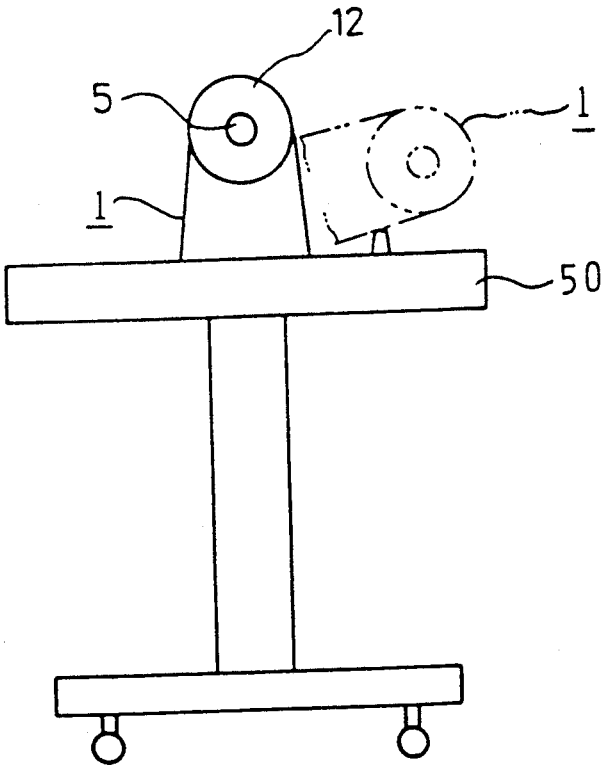

Referring to FIG. 2, a machine frame 1 of the sewing machine is constructed of a bed 2 having a substantially rectangular box shape and an arm 3 rising from a right end portion of the bed 2 and subsequently extending leftwardly. The machine frame 1 is placed on a table 50 shown in FIGS. 4 and 5. A rear portion of the bed 2 of the machine frame 1 is rotatably supported to the table 50 by means of hinges 60 shown in FIG. 4. Accordingly, the machine frame 1 is rearwardly tiltable with respect to the table 50. When the machine frame 1 is rearwardly tilted to tilt the arm 3 and erect the bed 2, a bottom portion of the bed 2 is opened. There are provided in the bed 2 a fabric feeding device, a thread cutting device such as a thread trimming device disclosed in U.S. Pat. No. 4,437,423, a rotating hook 45 and a lower shaft for driving these elements.

A machine motor 4 constructed as an AC servo motor is provided in a right upper portion of the arm 3 constituting the machine frame 1. A motor shaft 5 of the machine motor 4 projects from right and left ends of the motor 4. A left end of the motor shaft 5 is connected to an upper shaft 6. A needle bar 41 is vertically reciprocatably provided in a left lower portion of the arm 3. A needle 43 is mounted to the needle bar 41. The needle bar 41 is connected through the upper shaft 6 and a drive mechanism (not shown) to the machine motor 4. A timing pulley 7 is mounted on the upper shaft 6. A timing belt 8 is wrapped between the timing pulley 7 and the lower shaft in the bed 2. A driving torque of the machine motor 4 is transmitted through the timing belt 8 to the lower shaft, thereby driving the fabric feeding device, the thread cutting device and the rotating hook 45. A rotating drum 11 is mounted on an outer circumference of the right projecting portion of the motor shaft 5. A magnet 9 for detection of a rotational angle and a magnet 10 for detection of a magnetic pole position are mounted on the rotating drum 11. A pulley 12 for manual operation is mounted on an outer circumference of the further right projecting portion of the motor shaft 5. A rotational angle sensor 13 for detecting a magnetic flux of the magnet 9 is mounted on the right end of the machine motor 4 at a position below the rotating drum 11. The rotational angle sensor 13 is adapted to generate a signal corresponding to a rotational angle of the machine motor 4. A rotational angle and a rotational speed of the machine motor 4 and the upper shaft 6 are detected according to the signal from the rotational angle sensor 13. A support member 14 is mounted on the right end of the machine motor 4 at a position above the rotating drum 11. A printed board 15 is supported by the support member 14. The printed board 15 is formed with a central through-hole 15a. A boss 12a of the pulley 12 is mounted on the further right projecting portion of the motor shaft 5, and the boss 12a is inserted through the central through-hole 15a of the printed board 15. A magnetic pole sensor 16 for detecting a magnetic flux of the magnet 10 is mounted on a left lower surface of the printed board 15. According to a signal from the magnetic pole sensor 16, a magnetic pole position for deciding an excitation timing of windings in each phase of the machine motor 4 is detected. A mercury switch 17 as a tilt sensor is mounted on a left upper surface of the printed board 15. The mercury switch 17 is actuated when the arm 3 or the machine frame 1 is tilted at a predetermined angle. A magnet 18 for detection of a needle position is mounted on an inner surface of the pulley 12. A needle position sensor 19 (see FIG. 1) for detecting a magnetic flux of the magnet 18 to detect an upper position and a lower position of the needle 43 is provided on the printed board 15.

Figure 1:
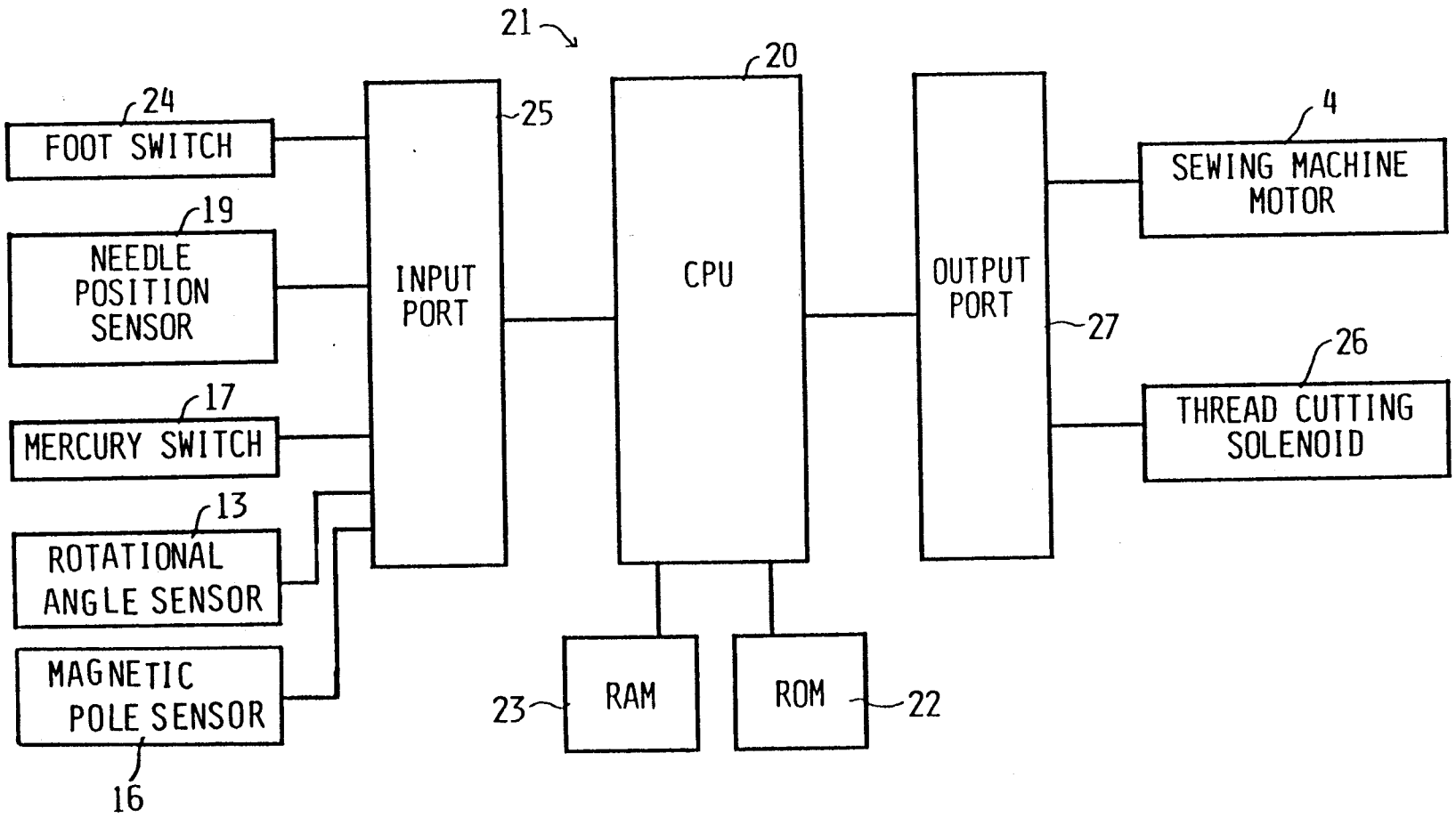
FIG. 1 is a schematic block diagram of an electrical construction in the sewing machine according to a first preferred embodiment of the present invention.

FIG. 1 is a block diagram of an electrical construction of the sewing machine. The construction of a control device 21 primarily comprised of a CPU 20 will now be described with reference to FIG. 1. The control device 21 includes a microcomputer. A ROM 22 for storing a program related to the flowchart shown in FIG. 3 and a RAM 23 are connected through a bus to the CPU 20. The CPU 20 is adapted to receive switch signals from a foot switch 24, the needle position sensor 19 and the mercury switch 17 through an input port 25. The CPU 20 controls the machine motor 4 and a thread cutting solenoid 26 through an output port 27 and a drive circuit (not shown). When the foot switch 24 is depressed forwardly from a neutral position, the machine motor 4 is driven. The foot switch 24 thus generates a switch signal for execution of sewing. Conversely, when the foot switch 24 is depressed rearwardly from the neutral position, the thread cutting solenoid 26 is driven. The foot switch 24 thus generates a switch signal for execution of thread cutting. Further, when the foot switch 24 is depressed forwardly from the neutral position, a sewing speed is set in accordance with an amount of depression of the foot switch 24. The thread cutting solenoid 26 and a cutting blade (not shown) comprise a thread cutting device provided in the bed 2. When the thread cutting solenoid 26 is excited, it drives the thread cutting blade to cut a thread.

The operation of the first preferred embodiment as mentioned above will now be described with reference to a flowchart shown in FIG. 3.

When a power switch is turned on, an operating condition is initialized in step S1. At this time, no operation is carried out, and the foot switch 24 is in the neutral position. Accordingly, the sewing machine is in a "stop" condition in step S2.

First, there will be described a procedure for carrying out a normal sewing operation. In this case, the machine frame 1 is not in a tilted condition, and the mercury switch 17 is therefore in an off state. When the foot switch 24 is depressed forwardly from the neutral position, the answer in step S3 becomes "YES". Since the mercury switch 17 is in the off state as mentioned above, the answer in step S4 becomes "NO". Accordingly, in step S5, the machine motor 4 is driven to carry out the sewing operation. At this time, a sewing speed is set according to an amount of depression of the foot switch 24. While the foot switch 24 is being depressed, the sewing operation continues to be carried out in accordance with the processing of steps S6 to S8. Thereafter, when the foot switch 24 is returned to the neutral position in step S8, the sewing speed is decelerated to become lower than the normal sewing speed in step S9. When the needle position becomes either the upper position or the lower position in step S10, the machine motor 4 is stopped to stop the movement of needle 43 in step S11. The program then returns to step S2.

On the other hand, when the machine frame is initially in the tilted condition, the mercury switch 17 is in an on state. Therefore, even if the foot switch 24 is erroneously depressed forwardly in step S3, the answer in step S4 becomes "YES". Accordingly, the sewing operation is not carried out.

Next, there will be described a procedure wherein the fabric feeding device, the thread cutting device and the rotating hook 45 in the bed 2 are adjusted by an operator while the machine motor 4 is driven under the tilted condition of the machine frame 1 where the bottom portion of the bed 2 is maintained open. In this case, in accordance with the processing of steps S2 to S5, the foot switch 24 is initially depressed forwardly under the condition where the machine frame 1 is not in the tilted condition, thereby carrying out the normal sewing operation. During the execution of the normal sewing operation, the machine frame 1 is tilted. As a result, the mercury switch 17 turns on, and the answer in step S6 accordingly becomes "YES". Then, the program proceeds to step S7 wherein a speed of the machine motor 4 is set to a constant low speed which is lower than the normal sewing speed and which is predetermined to adjust an operation of the sewing machine. Thereafter, while the foot switch 24 is being depressed forwardly, the driving of the motor 4 continues to be carried out at the constant low speed in accordance with the processing of steps S6 to S8. Accordingly, the operator can easily adjust the fabric feeding device, the thread cutting device and the rotating hook 45 in the bed 2 under the tilted condition of the machine frame 1, i.e., under the condition where the bottom portion of the bed 2 is maintained open, as the machine motor 4 is driven. Thereafter, when the foot switch 24 is returned to the neutral position, the answer in step S8 becomes "NO" in the same manner as in the previous case. Then, the speed is decelerated in step S9, and when the needle position becomes either the upper position or the lower position in step S10, the machine motor 4 is stopped to stop movement of the needle 43. Then, the program returns to step S2.

Meanwhile, there will now be described a procedure for carrying out a normal thread cutting operation. In this case, the machine frame 1 is not in the tilted condition, and the mercury switch 17 is, therefore, in the off state. Under this condition, when the foot switch 24 is depressed rearwardly from the neutral position, the answer in step S3 becomes "NO", and the answer in step S12 becomes "YES". Since the mercury switch 17 is in the off state, the answer in step S13 becomes "NO". Then, the program proceeds to step S14 in which the thread cutting solenoid 26 is driven to carry out thread cutting. The normal thread cutting operation is carried out in the following manner. The machine motor 4 is driven at a low speed for thread cutting to operate the needle in a half stroke from the lower position to the upper position. During this operation, the thread cutting solenoid 26 is driven to operate the thread cutting blade and thereby cut the thread. These operations are automatically carried out. Thereafter, the machine motor 4 and the thread cutting solenoid 26 are stopped in step S15. Then, the program returns to step S2.

Next, there will be described a procedure for adjusting the thread cutting device as the thread cutting solenoid 26 is driven. In this case, the foot switch 24 is depressed rearwardly under the condition where the machine frame 1 is initially in the tilted condition. At this time, the answer in step S3 becomes "NO". Further, the answer in step S12 becomes "YES", and the answer in step S13 becomes "YES". Then, the pulley 12 is manually rotated until the position of needle 43 becomes the low position. When the needle position reaches the low position, the answer in step S16 becomes "YES". Thereafter, the thread cutting solenoid 26 begins to be excited, and a timer for monitoring an excitation time of the thread cutting solenoid 26 begins to count. Then, the pulley 12 is manually rotated until the needle position is changed from the low position to the upper position. During this operation, the operator confirms whether the thread cutting device is normally operated as the pulley 12 is manually rotated. When the needle position reaches the upper position, the answer in step S19 becomes "YES", and the thread cutting solenoid 26 is stopped in step S20. Then, the program returns to step S12. Further, when the timer counts during the excitation of the thread cutting solenoid 26, the answer in step S17 becomes "YES", and the thread cutting solenoid 26 is stopped in step S20. Then, the program returns to step S12. Accordingly, burning of the thread cutting solenoid 26 is prevented.

According to the preferred embodiment as mentioned above, when the machine frame 1 is in the tilted condition, the machine motor 4 is inhibited from being driven even by operation of the foot switch 24. Accordingly, even when the foot switch 24 is erroneously operated, the machine motor 4 is not driven, and the needle 43 remains still, thus improving the safety of the machine. On the other hand, the machine motor 4 can be driven under the tilted condition of the machine frame 1. That is, the machine motor 4 is initially driven by depressing the foot switch 24 when the machine frame 1 is not in the tilted condition. Then, during the driving operation of the machine motor 4, the machine frame is tilted and the driving of the machine motor 4 is permitted to be continued even under the tilted condition of the machine frame 1. Accordingly, the machine motor 4 can be driven under the tilted condition of the machine frame 1, and the adjustment of the fabric feeding device, the thread cutting device and the rotating hook 45 can be easily carried out.

Furthermore, the thread cutting solenoid 26 can be driven under the tilted condition of the machine frame 1. Accordingly, the adjustment of the thread cutting device can be easily carried out.

Figure 6:
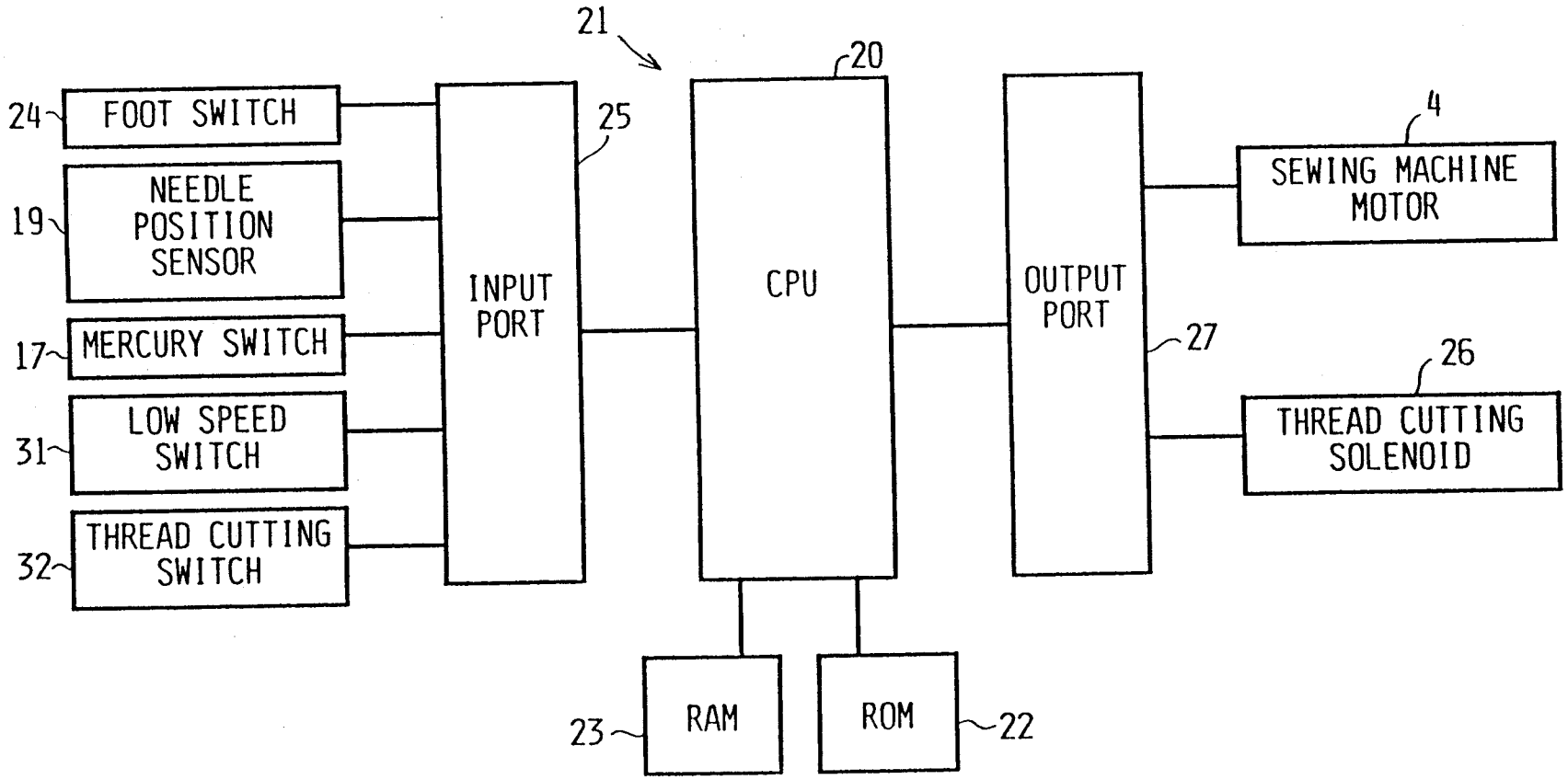
FIG. 6 is a schematic block diagram of an electrical construction of the sewing machine according to a second preferred embodiment of the present invention.

FIGS. 6 and 7 show a second preferred embodiment of the present invention. The following description of the second preferred embodiment will be directed to a construction different from that of the first preferred embodiment.

Referring to FIG. 6, switch signals from a low-speed switch 31 and a thread cutting switch 32 are input through the input port 25 to the CPU 20. The low-speed switch 31 is a switch used for driving the machine motor 4 at a constant low speed for adjustment of the sewing machine lower than the normal sewing speed under the tilted condition of the machine frame 1. The thread cutting switch 32 is a switch used for driving the thread cutting solenoid 26 under the tilted condition of the machine frame 1. The low-speed switch 31 and the thread cutting switch 32 are provided on an operation panel (not shown) mounted on the bed 2 or the arm 3 of the machine frame 1. A program related to a flowchart shown in FIG. 7 is stored in ROM 22.

The operation of the second preferred embodiment as mentioned above will now be described with reference to a flowchart shown in FIG. 7.

Referring to FIG. 7, when a power switch is turned on, an operating condition is initialized in step A1. At this time, no operation is carried out, and the foot switch 24 is in the neutral position. Accordingly, the sewing machine is in a "stop" condition in step A2.

Initially, there will be described a procedure for carrying out a normal sewing operation and a procedure for carrying out a normal thread cutting operation. In this case, the machine frame 1 is not in the tilted condition, and the mercury switch 17 is therefore in the off state. Accordingly, the answer in step A3 becomes "NO", and the normal sewing operation is carried out in step A4. In step A4, as described in the first preferred embodiment, while the foot switch 24 is being depressed forwardly, the machine motor 4 continues to be driven to carry out the normal sewing operation. Conversely, when the foot switch 24 is depressed rearwardly, the thread cutting solenoid 26 is driven to carry out the normal thread cutting operation.

When the machine frame 1 is in the tilted condition, the mercury switch 17 is in the on state, and the answer in step A3 accordingly becomes "YES". In the next step A5, the answer becomes "NO", and the program proceeds to step A10. As the answer in step A10 becomes "NO", the program returns to step A2. Thus, even if the foot switch 24 is erroneously depressed, the sewing operation and the thread cutting operation are not carried out under the tilted condition of the machine frame 1.

Next, there will be described a procedure for adjusting the fabric feeding device, the thread cutting device and the rotating hook 45 in the bed 2 as the machine motor 4 is driven under the tilted condition of the machine frame 1. In this case, when the low-speed switch 31 is turned on once under the tilted condition of the machine frame 1, that is, under the on state of the mercury switch 17, the answers in step A3 and step A5 becomes "YES". In the next step A6, a speed of the machine motor 4 is set to the constant low speed for adjustment, and the driving of the motor 4 is carried out at the constant low speed. This low-speed driving continues to be carried out until the low-speed switch 31 is turned on a second time as shown by a processing of step A6 and step A7. When the low-speed switch 31 is turned on the second time, the answer in step A7 becomes "YES". In the next step A8, when the needle position becomes either the upper position or the lower position, the low-speed driving is stopped, i.e., the machine motor 4 is stopped in step A9. Then, the program returns to step A2.

Next, there will be described a procedure for adjusting the thread cutting device by driving the thread cutting solenoid 26 under the tilted condition of the machine frame 1. In this case, when the thread cutting switch 32 is turned on under the tilted condition of the machine frame 1, the answer in step A3 becomes "YES", and the answer in step A5 becomes "NO" because the low-speed switch 31 is in the off state. Further, the answer in step A10 becomes "YES" because the thread cutting switch 32 is in the on state. Then, the pulley 12 is manually rotated until the needle position becomes the low position. When the needle position reaches the low position, the answer in step All becomes "YES". Then, the thread cutting solenoid 26 starts to be excited, and a timer for monitoring an excitation time of the thread cutting solenoid 26 begins counting in step A13. Then, the pulley 12 is manually rotated until the needle position is changed from the low position to the upper position. When the needle position reaches the upper position, the answer in step A14 becomes "YES", and the thread cutting solenoid 26 is stopped. Then, the program returns to step A2. In the above processing, the operator confirms whether the thread cutting device is normally operated. In the case where the timer counts during the excitation of the thread cutting solenoid 26, the answer in step A12 becomes "YES", and the thread cutting solenoid 26 is stopped in step A15. Then, the program returns to step A2.

Thus, the second preferred embodiment can obtain substantially the same effect as that obtained by the first preferred embodiment.

In the second preferred embodiment, under the tilted condition of the machine frame 1 where the bottom portion of the bed 2 is maintained open, the machine motor 4 can be driven at the constant low speed. Accordingly, when the rotating hook 45 is exchanged, the operator can easily check whether the rotating hook 45 normally meets the needle 43, or stitches are normally formed, as the machine motor 4 is driven at the constant low speed under the tilted condition of the machine frame 1. Further, when the thread cutting blade is exchanged, the operator can easily check whether the thread cutting device is normally operated, under the tilted condition of the machine frame 1.

In the above preferred embodiments, the present invention is applied to the industrial sewing machine. However, the application of the present invention is not limited to the above. For example, it may be applied to a home sewing machine. In this case, the present invention is applicable when the entire home sewing machine is tilted. Further, although the mercury switch 17 is employed to detect the tilt of the machine frame in the above preferred embodiments, another device such as a microswitch may be substituted for the mercury switch 17.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A motor driving device in a sewing machine comprising:

a machine motor fixed to a machine frame of the sewing machine, the machine frame being tiltable;

detecting means for detecting tilt of said machine frame;

drive inhibiting means for inhibiting drive of said machine motor when the tilt of the machine frame is detected by said detecting means;

inhibition canceling means for canceling inhibition of the drive of said machine motor by said drive inhibiting means; and control means for controlling the drive of said machine motor in such a manner that when the tilt of the machine frame is detected by said detecting means, said drive inhibiting means is actuated by said control means, while when said detecting means detects the tilt of said machine frame during driving of said machine motor, said inhibition canceling means is actuated by said control means.

2. The motor driving device as defined in claim 1, wherein said machine motor is drivable at at least two speeds, and said control means controls said machine motor to be driven at a low speed of said at least two speeds when said inhibition canceling means is actuated.

3. The motor driving device as defined in claim 1, further comprising a motor driving switch for driving said machine motor, and said control means controls so as to actuate said inhibition canceling means when said motor driving switch is operated.

4. A motor driving device in a sewing machine comprising:

a machine motor fixed to a machine frame of the sewing machine, the machine frame being tiltable;

detecting means for detecting tilt of the machine frame;

starting means for outputting a signal for driving said machine motor;

machine motor driving means for driving said machine motor in receipt of the signal from said starting means;

invalidating means for invalidating the signal from said starting means when the tilt of the machine frame is detected by said detecting means; and drive control means for controlling drive of said machine motor in such a manner that when said detecting means detects the tilt of the machine frame during driving of said machine motor driven by said machine motor driving means, the signal from said starting means is supplied to said machine motor driving means regardless of said invalidating means.

5. The motor driving device as defined in claim 4, wherein said drive control means controls said machine motor to be driven at a speed lower than a normal sewing speed.

6. A sewing machine comprising:

a machine frame;

a machine motor;

driving means for starting and driving the machine motor;

detecting means for detecting tilt of the machine frame with respect to a horizontal posture where a sewing operation is performed: and control means for inhibiting the driving means from starting the machine motor in a first detection state where the detecting means detects the tilt of the machine frame while the machine motor driving means is inoperative and for permitting the driving means to continue driving the machine motor in a second detection state where the detecting means detects the tilt of the machine frame while the machine motor driving means is operative.

7. A sewing machine according to claim 6, wherein the machine frame is tiltably mounted on a horizontal table of sewing machine and the machine motor is fixed to the machine frame.

8. A sewing machine according to claim 6, wherein the driving means is capable of selectively driving the machine motor at a sewing speed set to perform a sewing operation and at a speed lower than the sewing speed, and the control means controls the driving means to change a speed of the machine motor to the lower speed when the detecting means detects the tilt of the machine frame while the machine motor driving means is operative.

9. A sewing machine according to claim 6, wherein the driving means includes a switch member having a first operation state for starting and driving the machine motor and a second operation state for stopping the machine motor, and the control means permits the driving means to continue driving the machine motor in the second detection state while the switch member is in the first operation state.

10. A sewing machine according to claim 8, wherein the control means includes low speed setting means operative to cause the driving means to drive the machine motor at the lower speed, and permits the driving means to continue driving the machine motor in the second detection state while the low speed setting means is operating.

11. A sewing machine according to claim 10, wherein the driving means includes a switch member operable to start and stop the machine motor for performing a sewing operation, and the low speed setting means includes another switch member operable to permit and stop driving the machine motor at the lower speed.

12. A sewing machine according to claim 8, wherein the speed lower than the sewing speed is a constant low speed predetermined to adjust an operation of the sewing machine.

13. A sewing machine according to claim 6, further comprising a bobbin thread cutting device having an electromagnetic element, wherein the control means permits the electromagnetic element to be energized at least while the detecting means is detecting the tilt of the machine frame.

* * * * *